US009140038B2

(12) United States Patent
Naka

(10) Patent No.: US 9,140,038 B2
(45) Date of Patent: Sep. 22, 2015

(54) DOOR LOCK SYSTEM

(71) Applicant: U-SHIN LTD., Tokyo (JP)

(72) Inventor: Atsushi Naka, Aki-gun (JP)

(73) Assignee: U-SHIN LTD., Tokyo (JP)

( * ) Notice: Subject to any disclaimer, the term of this patent is extended or adjusted under 35 U.S.C. 154(b) by 86 days.

(21) Appl. No.: 13/687,061

(22) Filed: Nov. 28, 2012

(65) Prior Publication Data

US 2013/0134722 A1 May 30, 2013

(30) Foreign Application Priority Data

Nov. 28, 2011 (JP) ..... 2011-259115
Nov. 28, 2011 (JP) ..... 2011-259254

(51) Int. Cl.
*E05B 3/00* (2006.01)
*E05B 77/52* (2014.01)
*E05B 83/38* (2014.01)

(52) U.S. Cl.
CPC ..... *E05B 77/52* (2013.01); *E05B 83/38* (2013.01); *Y10T 292/57* (2015.04)

(58) Field of Classification Search
USPC ..... 292/336.3; 296/146.9
See application file for complete search history.

(56) References Cited

U.S. PATENT DOCUMENTS 2,438,238 A * 3/1948 Tonkin ..... 292/182
6,694,676 B2 * 2/2004 Sakamoto et al. ..... 49/366
7,992,925 B2 * 8/2011 Lagrut ..... 296/187.09
8,342,592 B2 * 1/2013 Konchan et al. ..... 296/146.1

* cited by examiner

*Primary Examiner* — Mark Williams
(74) *Attorney, Agent, or Firm* — Westerman, Hattori, Daniels & Adrian, LLP

(57) ABSTRACT

Provided is a door lock system for locking a rear door to a vehicle body of a vehicle in which an ingress/egress opening is opened and closed by a front door and the rear door being double opening doors, comprising: a disablement mechanism for switching an inner handle and latch units between connected/unconnected states, the inner handle provided in the rear door, the latch units being capable of keeping the rear door closed to the vehicle body; a base member provided with the disablement mechanism; and an operation member coming into contact with the front door, working in response to the opening-and-closing of the front door, and switching the disablement mechanism between connected/unconnected states, wherein the door lock system is provided in a front end portion of the rear door, and the operation member to come into direct contact with the front door is movably provided in the base member.

8 Claims, 14 Drawing Sheets

(a)

(b)

DOOR LOCK SYSTEM

BACKGROUND OF THE INVENTION

1. Field of the Invention

The present invention relates to a door lock system configured to lock a rear door to a vehicle body in a vehicle in which an ingress/egress opening is opened and closed by the front and rear, double opening doors.

2. Description of the Related Art

In the vehicle in which the ingress/egress opening is opened and closed by the front and rear, double opening doors, if the rear door can be independently opened earlier than the front door, it is likely that a higher safety standard cannot be obtained because the rear door might be opened before the vehicle pulls up.

Against this background, Japanese Patent Application Publication No. 2002-178756 (hereinafter referred to as Patent Document 1) has proposed an opening/closing system for a vehicle, which prohibits the opening of the rear door while the front door is closed, and which allows the opening of the rear door while the front door is opened. An example of this is shown in FIG. 13.

FIG. 13 is a diagram showing a basic structure of the opening/closing system proposed by Patent Document 1. The illustrated opening/closing system includes: an inner handle 101 provided to the rear door; a lock unit 102 configured to lock the rear door to the vehicle body; a disablement mechanism 103 configured to enable and disable the operation of the inner handle 101 to be transmitted to the lock unit 102; and an actuator (solenoid) 104 configured to switch the disablement mechanism 103 between a transmitting state and a non-transmitting state in response to the opening or closing of the front door. The opening/closing system disables the rear door to be opened while the front door is closed, because the opening and closing of the rear door are locked by the lock unit 102. Even if an occupant manipulates the inner handle 101 while the front door is closed, the manipulation force is not transmitted to the lock unit 102 because of the disablement mechanism 103. Thus, the rear door is kept locked by the lock unit 102, and accordingly remains unable to be opened.

In addition, Japanese Patent Application publication No. 2005-232716 (hereinafter referred to as Patent Document 2) has proposed a door lock system for similar double opening doors in which the states of the disablement mechanism are switched by a mechanical structure as shown in FIG. 14, instead of the actuator.

FIG. 14 shows a basic structure of a door latch system proposed by Patent Document 2. The illustrated door latch system controls the opening and closing of the rear door by: transmitting the operation of an operation lever 201, which is pressed by the front door, to a lock lever 203 of the disablement mechanism via a connecting rod 202; thus making a slide pin 204 work; and thereby switching the states (locked and unlocked states) of the connection between an open lever 206 connected to an inner handle 205 and a ratchet release lever 207.

SUMMARY OF THE INVENTION

Because the states of the disablement mechanism 103 are switched by the actuator 104, however, the structure proposed by Patent Document 1 has a problem of cost increase because the actuator 104 is needed for each of the left and right rear doors. In addition, the structure of Patent Document 1 has a problem that the system is complicated because the actuators

104 need to be controlled by independently detecting whether the left and right front doors are in an opened state or in a closed state.

Because the operation lever 201 and the main body of the door lock system are placed away from each other (are connected to each other by the connecting rod 202), the structure proposed by Patent Document 2 has a problem that the degree of freedom decreases in the layout of parts inside the door. In addition, the open lever 206 to work in response to the inner handle 205 and the ratchet release lever 207 to operate latch units 208, 209 are switched between the connected state and the unconnected state by the slide pin 204 worked with rotation of the lock lever 203. For this reason, the structure proposed by Patent Document 2 has a problem of having a complicated structure including a large number of parts.

The present invention has been made with the foregoing problems taken into consideration. An object of the present invention is to provide a door lock system which can be placed inside a rear door compactly.

In order to achieve the above object, a first aspect of the present invention provides a door lock system configured to lock a rear door to a vehicle body of a vehicle in which an ingress/egress opening is opened and closed by a front door and the rear door which are double opening doors, comprising: a disablement mechanism configured to switch an inner handle and latch units between a connected state and an unconnected state, the inner handle being provided in the rear door, and the latch units being capable of keeping the rear door closed to the vehicle body; a base member in which the disablement mechanism is placed; and an operation member configured to come into contact with the front door, to work in response to the opening and closing of the front door, and thereby to switch the disablement mechanism between a connected state and an unconnected state, wherein the door lock system is provided in a front end portion of the rear door, and the operation member configured to come into direct contact with the front door is movably provided in the base member.

A second aspect of the present invention is that wherein, in the first aspect, the operation member is slidably provided to the base member, the operation member is provided with a pin-shaped contact portion which is to come into contact with the front door, and the contact portion projects out toward the front door through a penetration hole formed in the rear door.

A third aspect of the present invention is that wherein, in the first or second aspect, the disablement mechanism includes: a turnable latch-side transmission lever having a first connection portion in one end portion, a second connection portion in the other end portion, and an engagement portion configured to receive manipulation force, the first connection portion connected to a connection member connected to one of the latch units, the second connection portion connected to a connection member connected to the other latch unit; and a handle-side transmission lever configured to advance and retreat in response to manipulation of the inner handle, and being swingable between a connected position in which the handle-side transmission lever engages with an engagement portion of the latch-side transmission lever and an unconnected position in which the engagement is released, the operation member is provided to be capable of advancing and retreating in a swing direction of the handle-side transmission lever, and the operation member switches the handle-side transmission lever between a connected position and an unconnected position by engaging with or disengaging from the handle-side transmission lever.

A fourth aspect of the present invention is that wherein, in the third aspect, the inner handle is pivotally supported at one end portion of the base member in a top-bottom direction by means of a support shaft extending in the top-bottom direction, the handle-side transmission lever of the disablement mechanism is placed in the other end portion of the base member in a way capable of advancing and retreating in the top-bottom direction, and a rotary lever shaped almost like a letter L is placed between the inner handle and the handle-side transmission lever, the rotary lever being pivotally supported by a support shaft which extends in a horizontal direction, one end of the rotary lever engaging with the inner handle, the other end of the rotary lever being joint-connected to the handle-side transmission lever, and the rotary lever converting turning force of the inner handle into advancing and retreating force of the handle-side transmission lever.

A fifth aspect of the present invention is that wherein, in the third or fourth aspect, a supporting portion is provided to one end of the handle-side transmission lever, the supporting member being swingably supported by the rotary lever configured to transmit operation of the inner handle to the handle-side transmission lever, and a front-side portion and a rear-side portion are provided to the other end of the handle-side transmission lever, the front-side portion being situated in a front of the latch-side transmission lever, and the rear-side portion being situated in a rear of the latch-side transmission lever.

A sixth aspect of the present invention is that wherein, in any one of the third to fifth aspects, a guide groove hole including a step portion and a long hole portion is formed in the handle-side transmission lever, the step portion configured to engage with the engagement portion of the latch-side transmission lever, the long hole portion configured to guide the engagement portion of the latch-side transmission lever without engaging with the engagement portion, biasing means for biasing the handle-side transmission lever from an unconnected position to a connected position is provided, the unconnected position being a position, in advancing and retreating direction of the handle-side transmission lever, where the engagement portion and the long hole portion are opposed to each other, the connected position being a position, in the advancing and retreating direction of the handle-side transmission lever, where the engagement portion and the step portion are opposed to each other, and the operation member includes a slider configured to hold the handle-side transmission lever in the unconnected position by pressing the handle-side transmission lever while the front door is closed, and to allow the handle-side transmission lever to move to the connected position by moving in a direction away from the handle-side transmission lever while the front door is opened.

A seventh aspect of the present invention is that wherein, in any one of the first to sixth aspects, the operation member includes: a first slider configured to come into contact with the front door; a second slider configured to operate the handle-side transmission lever provided to the disablement mechanism; a first spring configured to bias the first slider and the second slider toward the front door; and a second spring provided between the first slider and the second slider, and the base member includes a restriction member configured to engage with the second slider to thereby prevent the second slider from moving toward the disablement mechanism by a predetermined amount or more.

An eighth aspect of the present invention is that wherein, in any one of the first to seventh aspects, the inner handle is pivotally supported by the base member.

In the first aspect of the present invention, the door lock system is placed in the front end portion of the rear door, and the operation member configured to come into contact with the front door is placed in the base member. Accordingly, connecting means, such as rods, for transmitting the operation of the operation member to the door lock system is no longer necessary; the door lock system, inclusive of the operation member, can be compactly placed in the front end portion of the rear door; and the degree of freedom can be enhanced in the shape of the rear door and the layout of parts inside the rear door.

In the second aspect of the present invention, the operation member is formed as the slide member. Accordingly, the structure can be simplified. Furthermore, the pin-shaped contact portion of the operation member is configured to project outwards through the penetration hole of the rear door. Accordingly, the part of the operation member which is configured to project from the rear door can be accordingly made in a smaller size; and the aesthetic impression can be enhanced.

In the third aspect of the present invention, a slide pin for switching the handle-side transmission lever between the connected position and the unconnected position becomes no longer necessary. Accordingly, it is possible to reduce the number of parts, and to simplify the structure.

In the fourth aspect of the present invention, the inner handle is placed in the base member. Accordingly, it is possible to achieve the parts integration, and to place the door lock system inside the rear door more compactly. Moreover, although the inner handle is placed in the base member, the door lock system can be constructed simply because the turning force of the inner handle can be directly transmitted to the handle-side transmission lever of the disablement mechanism by means of the single rotary lever.

In the fifth aspect of the present invention, the handle-side transmission lever is constructed to interpose the latch-side transmission lever between the front-side portion and the rear-side portion. Accordingly, the position of the handle-side transmission lever is restricted when the front-side portion and the rear-side portion of the handle-side transmission lever come into contact with the latch-side transmission lever. Consequently, the connection between the handle-side transmission lever and the latch-side transmission lever is securely maintained; other members for stopping the other side portion of the handle-side transmission lever from rising becomes no longer necessary; the number of parts is reduced; and the door lock system is constructed simply.

In the 6th aspect of the present invention, while the front door is in the closed state, the handle-side transmission lever is held in the unconnected position by being pressed by the slider. Even if the occupant manipulates the inner handle while in this state, the engagement portion of the latch-side transmission lever only moves inside the long hole portion of the guide groove hole of the handle-side transmission lever, as well as the latch-side transmission lever and the handle-side transmission lever are accordingly not connected together. For this reason, the rear door cannot be opened.

Once the front door is switched from the closed state to the opened state, the slider moves in the direction away from the handle-side transmission lever, and the handle-side transmission lever accordingly moves from the unconnected position to the connected position due to the biasing force of the biasing means. While the front door is in the opened state in this manner, the engagement portion of the latch-side transmission lever is capable of engaging with the step portion of the guide groove hole of the handle-side transmission lever while opposed to the step portion. For this reason, the latch-side transmission lever and the handle-side transmission lever enter into the connected state. Once the inner handle is manipulated, the latch-side transmission lever is turned; the latch units are thus operated by means of the connecting members; the rear door is unlocked: and the rear door can be opened.

In addition, once the state of the front door shifts to the opened state in response to the manipulation of the inner handle while the front door is in the closed state, the slider moves in the direction away from the handle-side transmission lever, but the engagement portion of the latch-side transmission lever remains situated in the long hole portion of the guide groove hole of the handle-side transmission lever. For this reason, the handle-side transmission lever remains situated in the unconnected position against the biasing force of the biasing means. Thereafter, once the manipulation of the inner handle is released, the handle-side transmission lever moves in the advancing and retreating direction of the handle-side transmission lever, the engagement portion of the latch-side transmission lever leaves the long hole portion of the guide groove hole of the handle-side transmission lever, and the handle-side transmission lever accordingly moves to the connected position due to the biasing force of the biasing means. Subsequently, once the inner handle is manipulated again, the rear door can be opened as described above because the handle-side transmission lever is situated in the connected state.

Even in the case where, as described above, the front door shifts to the opened state after the inner handle is manipulated while the front door is in the close state, the rear door becomes able to be opened when the manipulation of the inner handle is released once and the inner handle is manipulated again. Accordingly, the door lock system having this function can be constructed simply.

In the 7th aspect of the present invention, the second spring is interposed between the first slider and the second slider, and the base member is provided with the restriction portion configured to restrict the movement of the second slider beyond the predetermined limit. Accordingly, it is possible to restrict the movement of the second slider configured to operate the disablement mechanism beyond the necessary amount; to make the second spring absorb the variation in the distance between the rear end portion of the front door closed to the vehicle body and the operation member of the door lock system which is placed in the rear door; and to always make the disablement mechanism work securely.

In the 8th aspect of the present invention, the inner handle is additionally placed in the base member in which the disablement mechanism and the operation member are placed. Accordingly, it is possible to achieve the parts integration, and to place the door lock system inside the rear door compactly.

DESCRIPTION OF THE PREFERRED EMBODIMENT

Descriptions will be hereinbelow provided for an embodiment of the present invention on the basis of the accompanying drawings.

Figure 1:
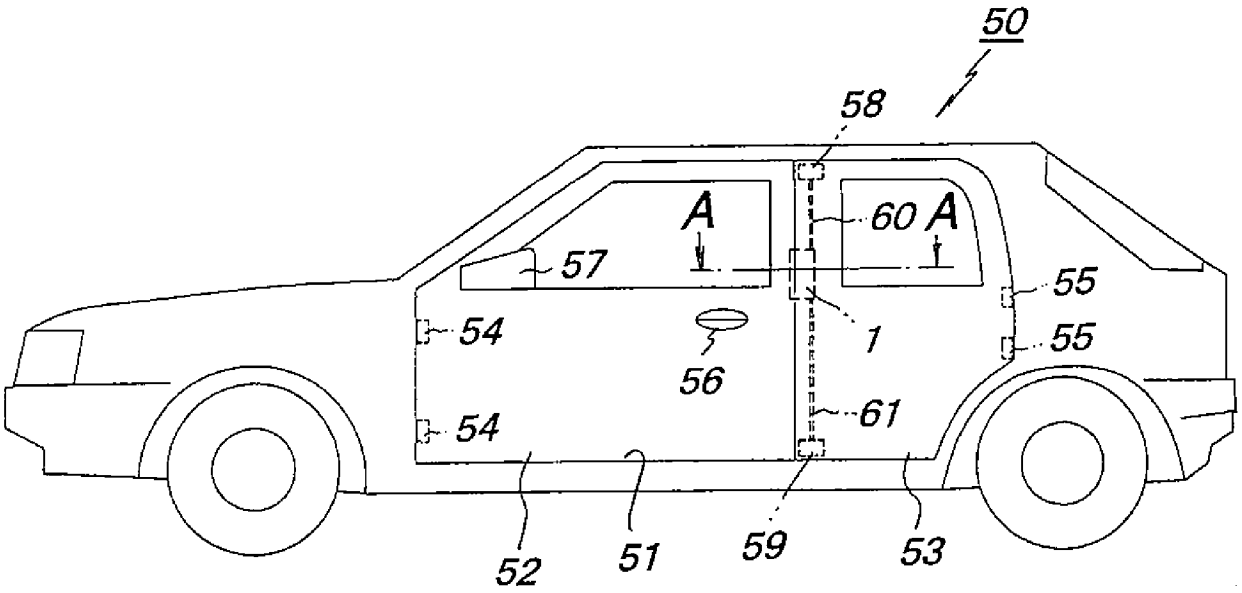
FIG. 1 is a side view of a vehicle including a door lock system of the present invention.
Figure 2:
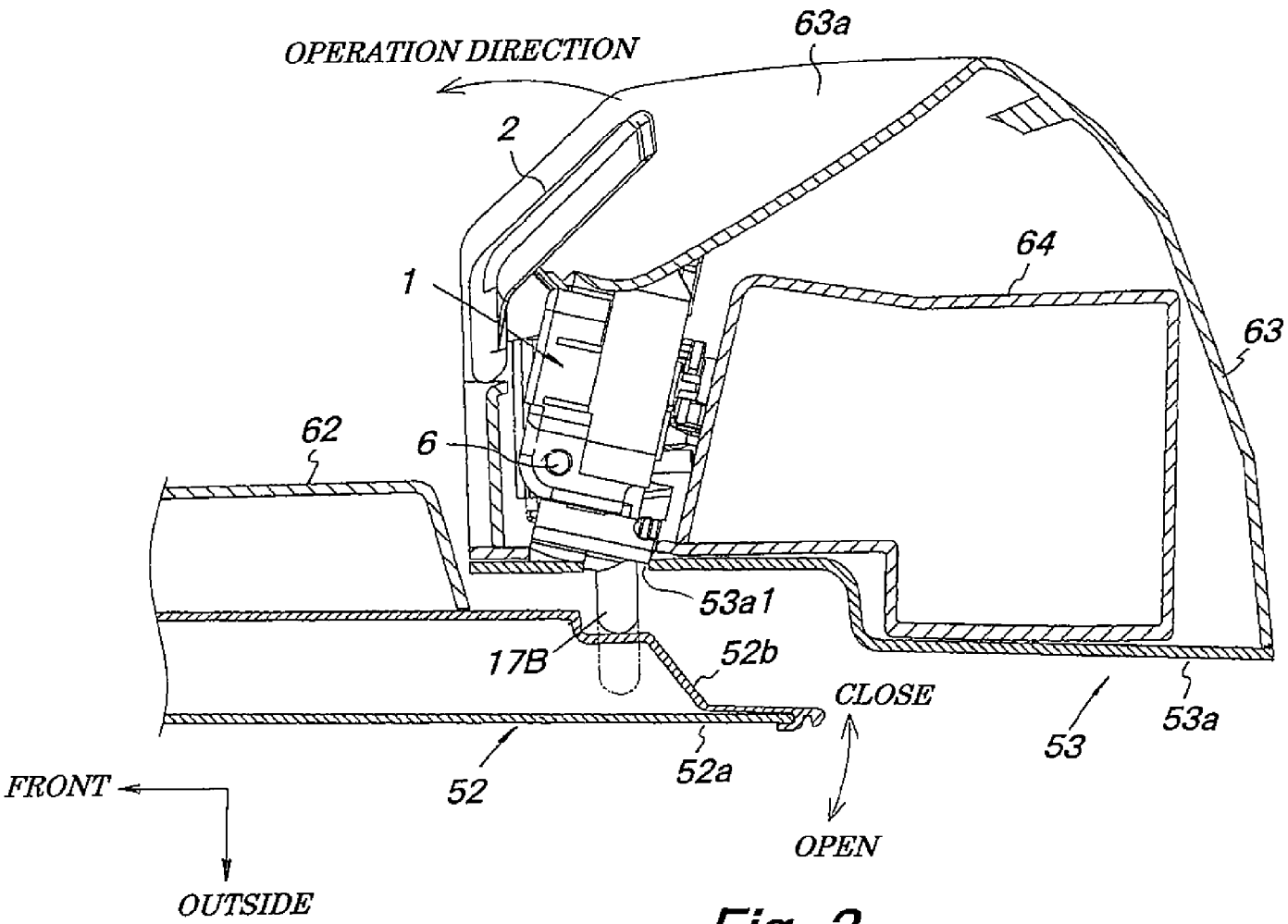
FIG. 2 is a cross-sectional view of the vehicle taken along the A-A line of FIG. 1.

FIG. 1 is a side view of a vehicle including a door lock system of the present invention. FIG. 2 is a cross-sectional view of the vehicle taken along the A-A line of FIG. 1. Each of left and right ingress/egress openings 51 which are opened in the two sides of a vehicle 50 shown in FIG. 1 is opened and closed by a front door 52 and a rear door 53 which are double opening doors. In this respect, the front end part of the front door 52 is openably and closably supported by the vehicle body by means of upper and lower hinges 54. The rear end part of the rear door 53 is openably and closably supported by the vehicle body by means of upper and lower hinges 55. In addition, the front door 52 is provided with a door handle 56 used for the front door 52 to be opened and closed from the outside of the vehicle; and a door rear-view mirror 57 with which to see the rear of the vehicle.

Furthermore, as shown in FIG. 1, latch units 58, 59 are provided in the top and bottom of the front end part of the rear door 53, respectively. A door lock system 1 of the present invention is placed in a position which is in the middle of the height of the front end part of the rear door 53 (a position in the middle between the upper and lower latch units 58, 59 in the vertical direction). Moreover, the upper and lower latch units 58, 59 are connected to the door lock system 1 via control cables 60, 61 which are connecting members.

It should be noted that albeit not illustrated, each of the upper and lower latch units 58, 59 includes: a fork capable of engaging with and disengaging from a striker provided to the vehicle body; and a claw configured to keep the fork and the striker locked to each other by engaging with the fork. Thus, once an inner handle 2 is manipulated by an occupant (see FIG. 2) inside the vehicle compartment, the rear door 53 is made able to be opened by: transmitting the manipulation force to the upper and lower latch units 58, 59 via the door lock system 1 and the control cables 60, 61; operating the claws of the respective latch units 58, 59; and releasing the engagement of the fork with the striker in each of the latch units 58, 59.

Moreover, the front door 52 and the rear door 53 of the present embodiment which are the double opening doors are configured in a way that: the front door 52 is opened prior to the rear door 53; and the rear door 53 is allowed to be opened after the opening of the front door 52.

In the meantime, as shown in FIG. 2, the front door 52 is constructed with a hollow structure by joining the peripheries of an outer panel 52*a* and an inner panel 52*b*, which is placed inward of the outer panel 52*a*, to each other by a hemming process or the like. The inner side of the front door 52 is covered with a door trim 62. Furthermore, in the rear door 53, a door frame 64 shaped like a rectangle is placed in the top-bottom direction (the vertical direction in FIG. 2) inside a space defined by an outer panel 53*a* and a door trim 63 which is provided inward of the outer panel 53*a*. The door lock system 1 is attached to the front end surface of the door frame 64. This door lock system 1 is provided with the inner handle 2 manipulatable to turn in a direction indicated with an arrow. A recessed portion 63*a* used for the occupant to manipulate the inner handle 2 with his/her hand inserted in the recess portion 63*a* is formed in the door trim 63.

Descriptions will be hereinbelow provided for the detail of the structure of the door lock system 1 of the present invention on the basis of FIGS. 3 to 7A and 7B.

Figure 3:
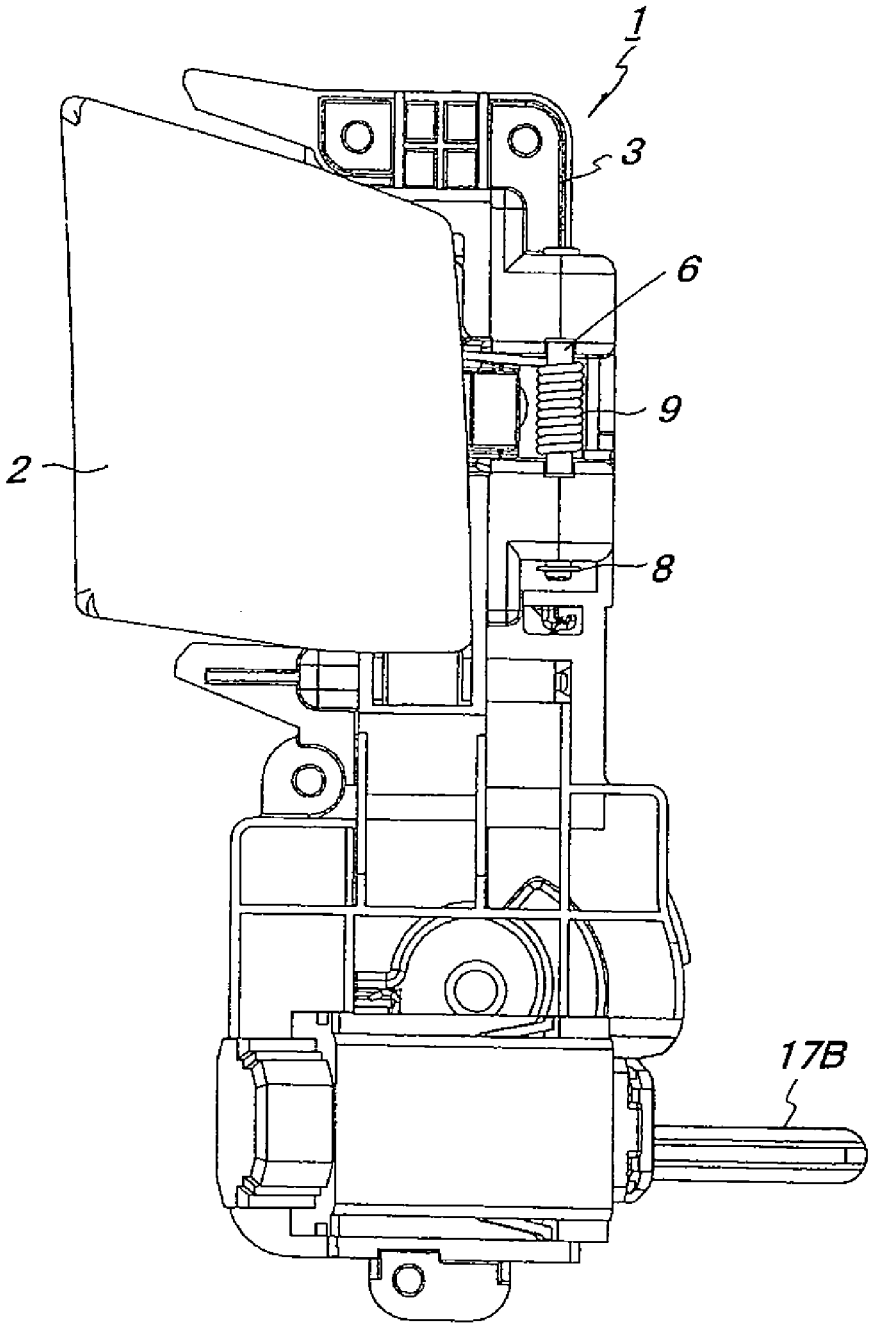
FIG. 3 is a front view of the door lock system of the present invention.
Figure 4:
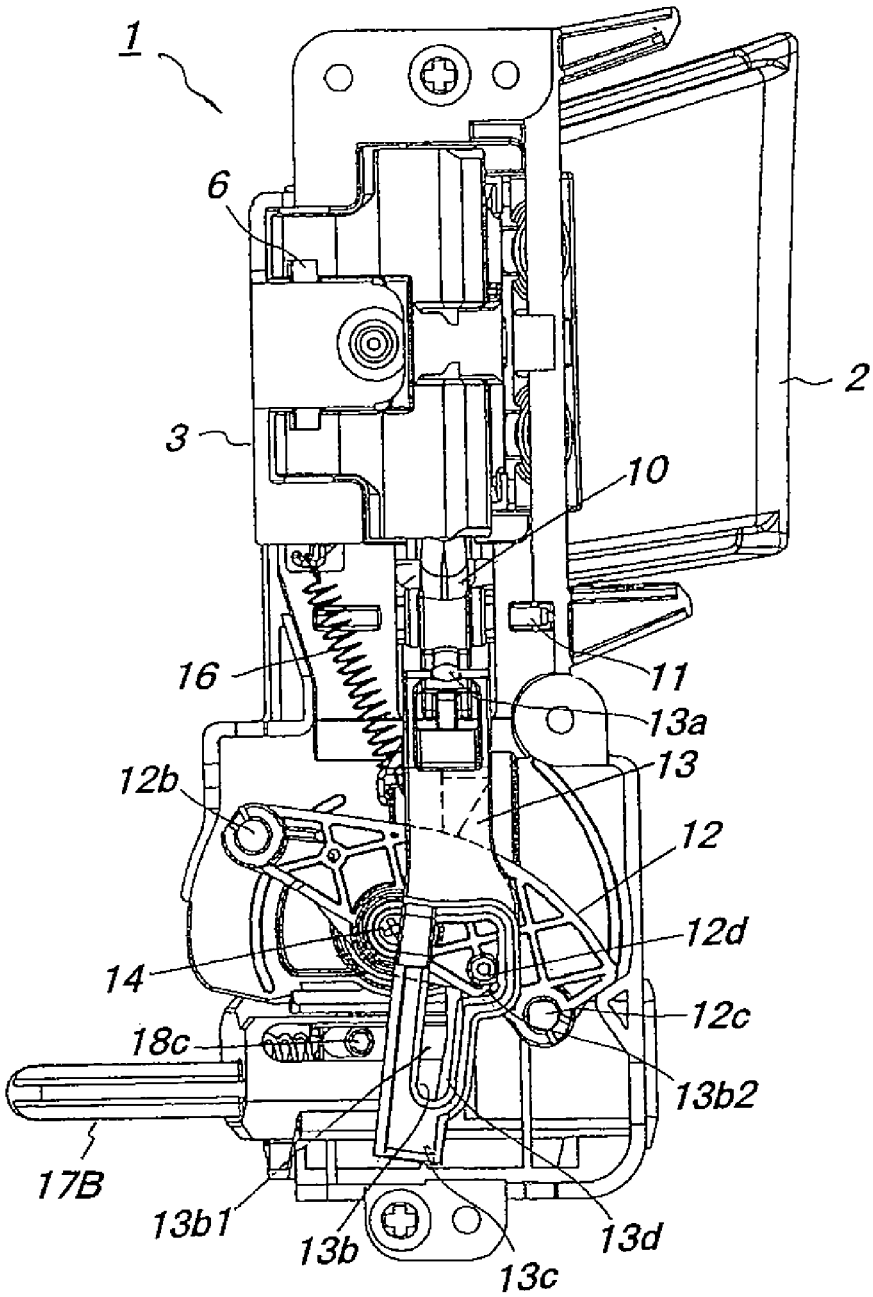
FIG. 4 is a rear view of the door lock system of the present invention.
Figure 5:
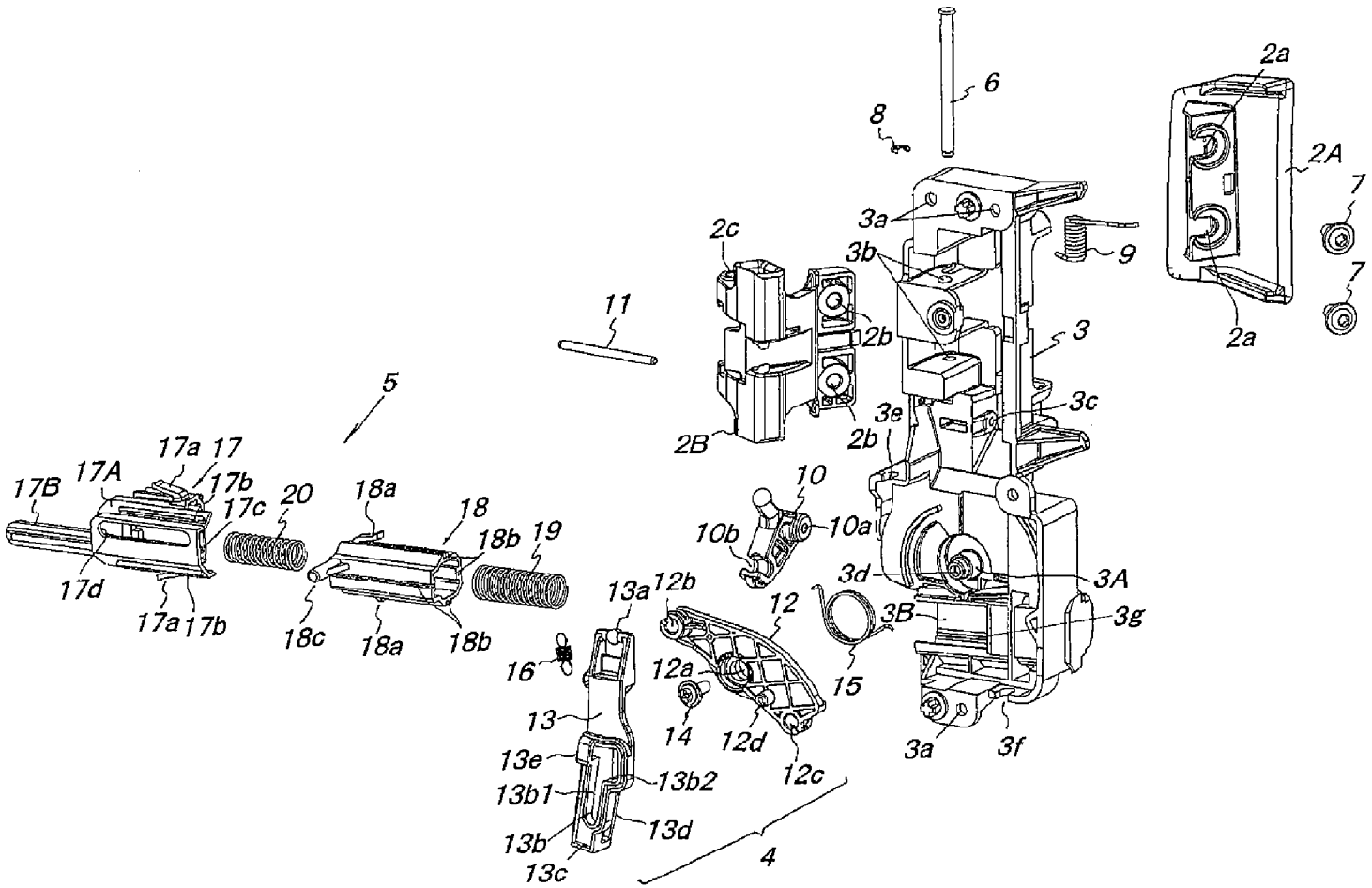
FIG. 5 is an exploded perspective view of the door lock system of the present invention.
Figure 6:
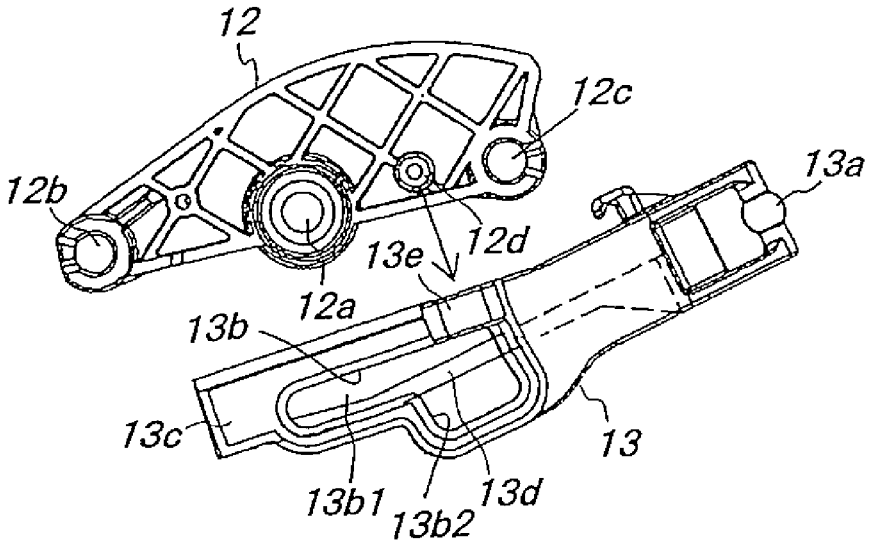
FIG. 6 is a diagram showing an assembled structure in which a latch-side transmission lever and a handle-side transmission lever of the door lock system of the present invention are assembled together.

FIG. 3 is a front view of the door lock system of the present invention. FIG. 4 is a rear view of the door lock system. FIG. 5 is an exploded perspective view of the door lock system. FIG. 6 is a diagram showing an assembled structure in which a latch-side transmission lever and a handle-side transmission lever of the door lock system are assembled together. FIGS. 7A and 7B are partial side cross-sectional view showing: the structure of an operation member of the door lock system; and how the operation member works.

The door lock system 1 of the present invention is formed from: a base member 3; and the inner handle 2, a disablement mechanism 4 and an operation member 5 which are provided to the base member 3. In this respect, the base member 3 is a member which is longer in the top-bottom direction. As shown in FIG. 2, the door lock system 1 is attached to the front end surface of the door frame 64 of the rear door 53 by means of screws (not illustrated) which are inserted, respectively, into two of left and right screw holes 3*a* (see FIG. 5) formed in the upper end part of the base member 3 as well as one screw hole 3*a* formed in the lower end portion of the base member 3.

In addition, the inner handle 2 is pivotally supported by the upper part of the base member 3 by means of a support shaft 6 which is inserted into the inner handle 2 and the upper part of the base member 3 in the vertical direction. In this respect, as shown in FIG. 5, the inner handle 2 is formed from a manipulation portion 2A and a supporting portion 2B which are fastened together by means of two of upper and lower screws 7. To put it specifically, the inner handle 2 is constructed by: inserting the screws 7 into two cut-off holes 2*a* which are formed in upper and lower parts of the manipulation portion 2A; screwing these screws 7 into two screw holes 2*b* which are formed in upper and lower parts of the supporting portion 2B; and thereby fastening the manipulation portion 2A and the supporting portion 2B together. Furthermore, this inner handle 2 is pivotally supported by the base member 3 by: from above, inserting the support shaft 6 into shaft insertion holes 2*c*, 3*b*, which are penetratingly provided to the supporting portion 2B and the base member 3 in the longitudinal direction; and fitting a C-ring 8 to the lower end of the support shaft 6. The inner handle 2 is biased to its initial position by a spring 9.

Furthermore, a rotary lever 10 is pivotally supported by the base member 3 at a position in the middle of the height of the base member 3 by means of a support shaft 11. The rotary lever 10 is a member configured to turn around the support shaft 11 in response to the manipulation to turn the inner handle 2. As shown in FIG. 5, the rotary lever 10 is pivotally supported by the base member 3 by means of the support shaft 11 which is inserted into: a shaft supporting hole 10*a* formed in the upper end of the rotary lever 10 in the lateral direction; and a shaft supporting hole 3*c* penetratingly provided in the base member 3 in the lateral direction. The upper end part of the rotary lever 10 engages with the inner handle 2. In addition, a support bearing portion 10*b* shaped like a notch is formed in the lower end of the rotary lever 10.

Moreover, the disablement mechanism 4 and the operation member 5 are provided to a lower half of the base member 3. In this respect, the disablement mechanism 4 is configured to switch the inner handle 2 and the latch units 58, 59 (see FIG. 1) between the connected state and the unconnected state. The disablement mechanism 4 includes: a latch-side transmission lever 12 whose middle portion is pivotally supported by the base member 3; and a handle-side transmission lever 13 which is swingably supported by the base member 3 with the upper end of the handle-side transmission lever 13 connected to the rotary lever 10.

A screw insertion hole 12*a* shaped like a circular hole is formed in the middle part of the latch-side transmission lever 12. The latch-side transmission lever 12 is pivotally supported by the base member 3 by screwing a screw 14, which is inserted into the screw insertion hole 12*a*, into a screw hole 3*d* in a shaft portion 3A projectingly provided to the base member 3. This latch-side transmission lever 12 is biased by a coil spring 15 in a lock direction (a clockwise direction in FIG. 1). In addition, a first connection portion 12*b* to which the control cable 60 (see FIG. 1) leading to the upper latch unit 58 (see FIG. 1) is connected is formed in one end of the latch-side transmission lever 12. A second connection portion 12*c* to which the control cable 61 (see FIG. 1) leading to the lower latch unit 59 (see FIG. 1) is connected is formed in the other end of the latch-side transmission lever 12. Furthermore, an engagement portion 12*d* shaped like a pin is integrally projectingly provided to the latch-side transmission lever 12. Incidentally, cable holding portions 3*e*, 3*f* are formed in the base member 3. The cable holding portion 3*e* is configured to hold the control cable 60 connected to the first connection portion 12*b* of the latch-side transmission lever 12, and the cable holding portion 3*f* is configured to hold the control cable 61 connected to the second connection portion 12*c* of the latch-side transmission lever 12.

The handle-side transmission lever 13 is joint-connected to the lower end of the rotary lever 10 by fitting a ball-shaped supporting portion 13*a*, which is provided to the upper end of the handle-side transmission lever 13, into the support bearing portion 10*b* formed in the lower end of the rotary lever 10. Furthermore, a guide groove hole 13*b* with which the engagement portion 12*d* projectingly provided to the latch-side transmission lever 12 engages is formed in the handle-side transmission lever 13. The guide groove hole 13*b* is formed from: a long hole portion 13*b*1, long in the top-bottom direction, configured to guide the engagement portion 12*d* of the latch-side transmission lever 12 while avoiding the engagement with the engagement portion 12*d*; a step portion 13*b*2 configured to engage with the engagement portion 12*d* of the latch-side transmission lever 12. Moreover, a front-side portion 13*c* and a rear-side portion 13*d* which look like prongs of a fork are provided to the handle-side transmission lever 13, and a protrusion 13*e* is formed on the handle-side transmission lever 13.

In this respect, FIG. 6 shows an assembled structure in which the latch-side transmission lever 12 and the handle-side transmission lever 13 are assembled together. The handle-side transmission lever 13 and the latch-side transmission lever 12 are assembled together through the following steps. First, the engagement portion 12*d* of the latch-side transmission lever 12 is made to pass through the protrusion 13*e* of the handle-side transmission lever 13, and is fitted into the guide groove hole 13*b*, because the protrusion 13*e* which allows the engagement portion 12*d* of the latch-side transmission lever to pass through the protrusion 13*e* is formed in the handle-side transmission lever 13. Second, the latch-side transmission lever 12 is inserted between the front-side portion 13*c* and the rear-side portion 13*d* of the handle-side transmission lever 13 by turning the resultant latch-side transmission lever 12 in the clockwise direction in FIG. 6.

Thus, the handle-side transmission lever 13 is swingable between a connected position at which the engagement portion 12*d* of the latch-side transmission lever 12 engages with the step portion 13*b*2 of the guide groove hole 13*b* and an unconnected position at which the engagement is released. The handle-side transmission lever 13 is biased to the connected position (in the clockwise direction in FIG. 4) by a spring 16 which is installed between the handle-side transmission lever 13 and the base member 3 in a compressed manner.

The operation member 5 is slidably housed in a recessed operation member housing portion 3B, which is formed in the lower part of the base member 3 shown in FIG. 5 in the lateral direction, so that the operation member 5 can slide in the lateral direction (in a swing direction of the handle-side transmission lever 13). The operation member 5 is a member configured to switch the handle-side transmission lever 13 between the connected position and the unconnected position by engaging with the handle-side transmission lever 13 through these slides. Incidentally, as shown in FIG. 5, rail-shaped grooves 3*g* (only one of which is illustrated in FIG. 5) are formed in the respective upper and lower parts of the operation member housing portion 3B of the base member 3 in the lateral direction.

Figure 7:
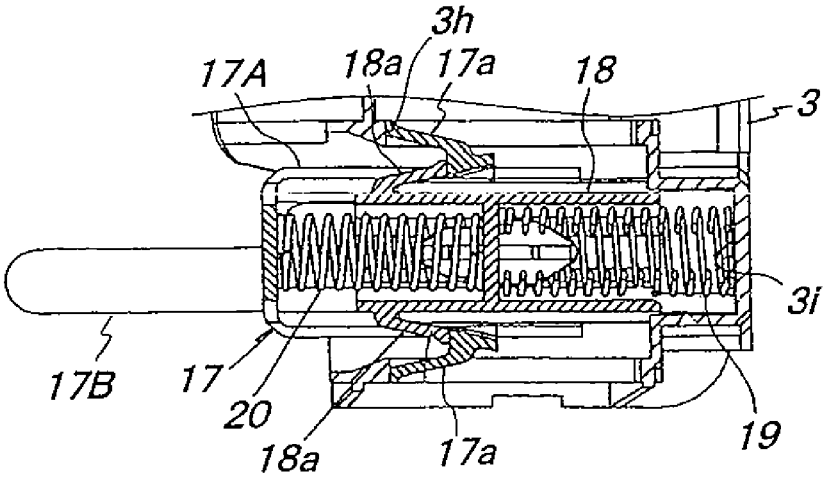
FIGS. 7A and 7B are partial side cross-sectional views showing: a structure of an operation member of the door lock system of the present invention; and how the operation member works.
Figure 7:
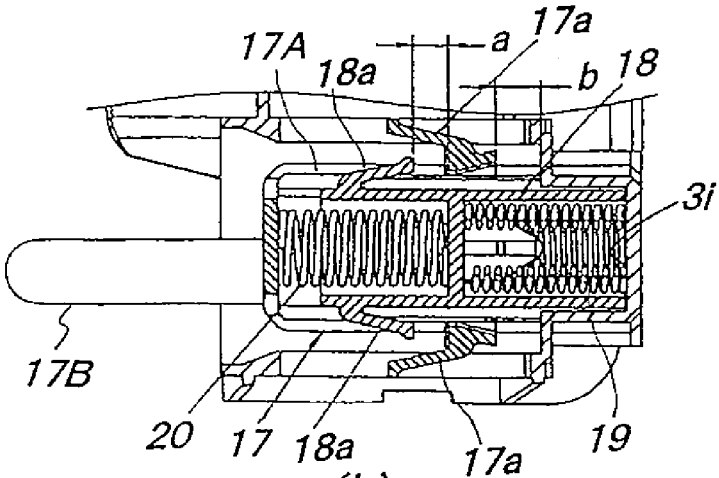

In this respect, as shown in FIG. 5 and FIG. 7, the operation member 5 includes: a first slider 17 configured to come into contact with the front door 52; a second slider 18 configured to operate the handle-side transmission lever 13 of the disablement mechanism 4; a first spring 19 configured to bias the first slider 17 and the second slider 18 toward the front door 52 (leftward in FIG. 5 and FIG. 7); and a second spring 20 installed between the first slider 17 and the second slider 18. Incidentally, the biasing force (spring constant) of the first spring 19 is set smaller than the biasing force (spring constant) of the second spring 20.

The first slider 17 includes: a main body portion 17A shaped like a rectangular cylinder; and a pin-shaped contact portion 17B projecting from the main body portion 17A. As shown in FIG. 2, the contact portion 17B projects out of the outer panel 53*a* after passing through a penetration hole 53*a*1 which is formed in the outer panel 53*a* of the rear door 53. The front end of the contact portion 17B is in contact with the inner panel 52*b* of the front door 52, while the front door 52 is closed.

Engagement claws 17*a*, and rail-shaped protrusions 17*b* which are long in the lateral direction, are formed on the upper and lower parts of the main body portion 17A of the first slider 17, respectively. Rail-shaped protrusions 17*c* (only one of which is illustrated in FIG. 5) are formed on the left, right, upper and lower inner walls of the main body portion 17A. In addition, a guide groove 17*d* which is long in the lateral direction is formed in one lateral part of the main body portion 17A. The first slider 17 is slidably housed in and held by the base member 3 in the lateral direction by fitting the rail-shaped protrusions 17*b*, which are formed on the upper and lower parts of the main body portion 17A, into the rail-shaped grooves 3*g* which are formed in the upper and lower parts of the operation member housing portion 3B of the base member 3. The first slider 17 is prevented from coming out of the base member 3 by making the engagement claws 17*a*, which are formed on the upper and lower parts of the main body portion 17A, engage with step portions 3*h* of the base member 3, respectively, as shown in FIG. 7A.

The second slider 18 is formed in the shape of a rectangular cylinder. Engagement claws 18*a* are formed on the upper and lower parts of the second slider 18. Rail-shaped grooves 18*b* are formed in the upper, lower, left lateral and right lateral surfaces of the second slider 18 in the lateral direction, respectively. In addition, a horizontal operation portion 18*c* shaped like a circular column is projectingly provided to one lateral surface of the second slider 18 in an integrated manner. The second slider 18 is slidably housed in the inside of the first slider 17 by fitting the rail-shaped protrusions 17*c*, which are formed on the upper, lower, left and right inner walls of the main body portion 17A of the first slider 17, into the rail-shaped grooves 18*b* which are formed in the upper, lower, left lateral and right lateral surfaces of the second slider 18 with the operation portion 18*c* engaging with the guide groove 17*d* which is formed in the main body portion 17A of the first slider 17. The second slider 18 is prevented from coming out of the first slider 17 by making the engagement claws 18*a*, which are formed on the upper and lower parts of the second slider 18, engage with the engagement claws 17*a* of the first slider 17, as shown in FIG. 7A. Incidentally, as shown in FIG. 7A, an end surface of the operation member housing portion 3B of the base member 3 constitutes a restriction portion 3*i* configured to restrict the movement of the second slider 18 toward the handle-side transmission lever (rightward in FIG. 7A) beyond a predetermined limit by engaging with the second slider 18.

Next, descriptions will be provided for how the door lock system 1 of the present invention, which is constructed as described above, works on the basis of FIG. 8 to FIG. 12.

Figure 8:
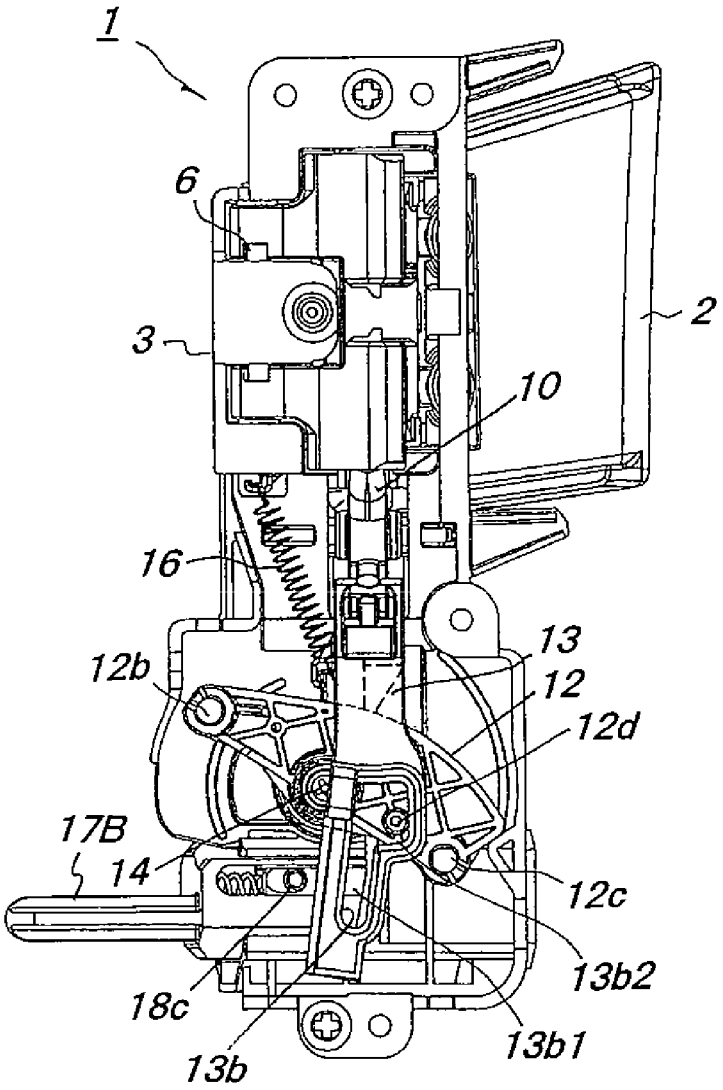
FIG. 8 is a rear view showing the door lock system of the present invention, which shows an unlocked state of the door lock system.
Figure 9:
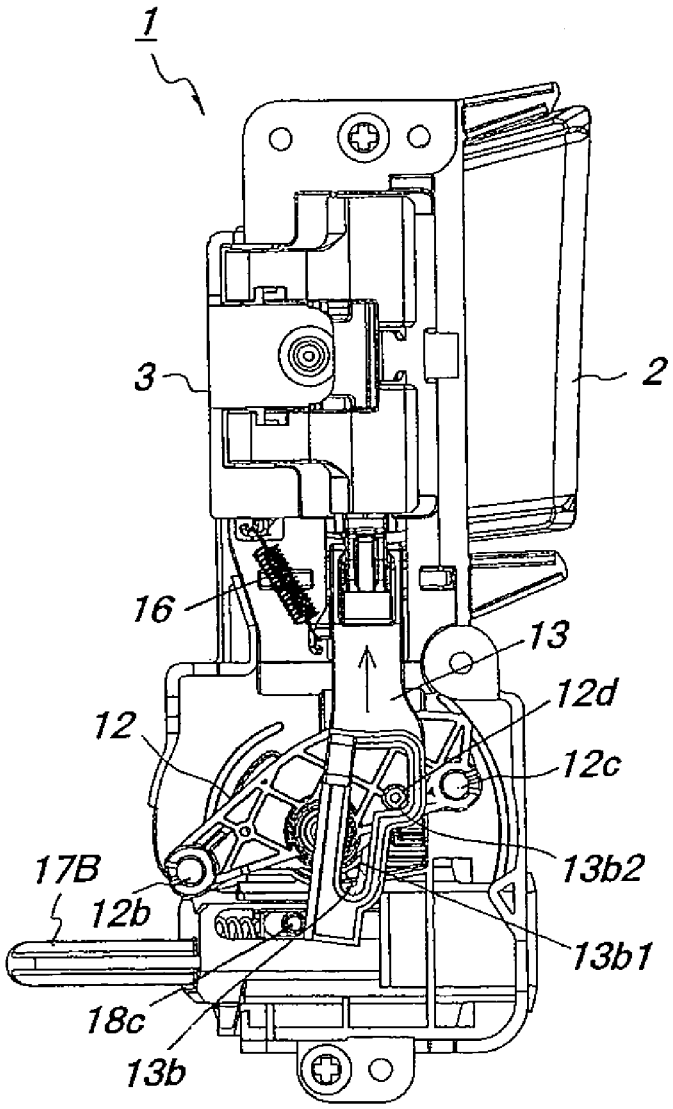
FIG. 9 is a rear view of the door lock system of the present invention, which shows a state in which an inner handle is manipulated while the door lock system is in the unlocked state.
Figure 10:
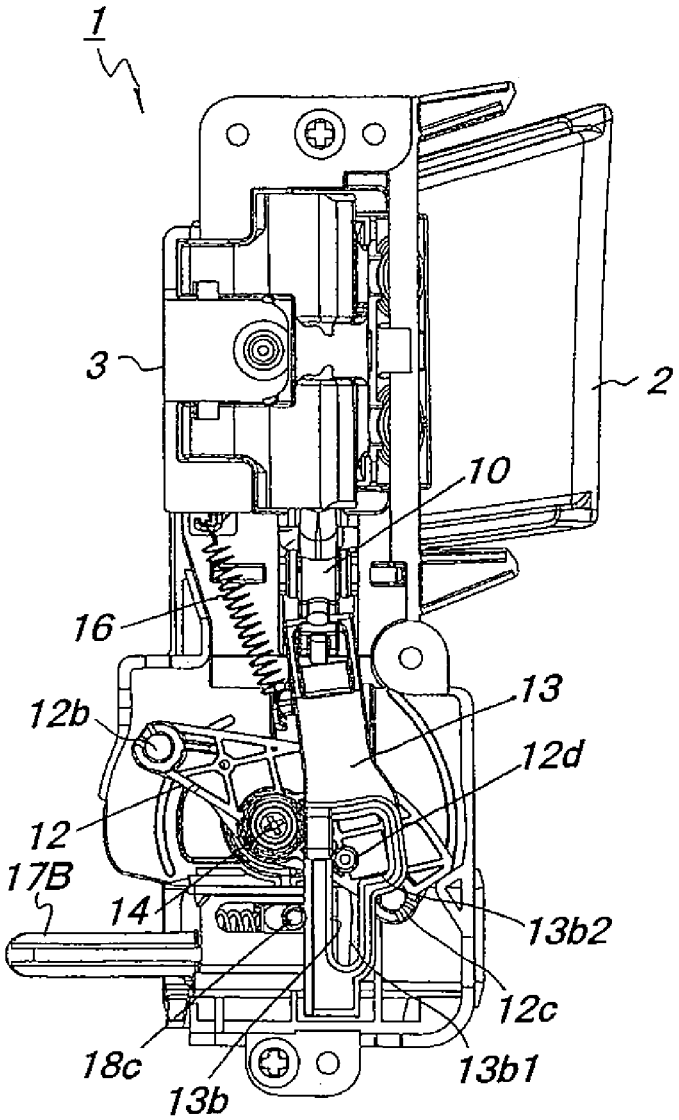
FIG. 10 is a rear view of the door lock system of the present invention, which shows a locked state of the door lock system.
Figure 11:
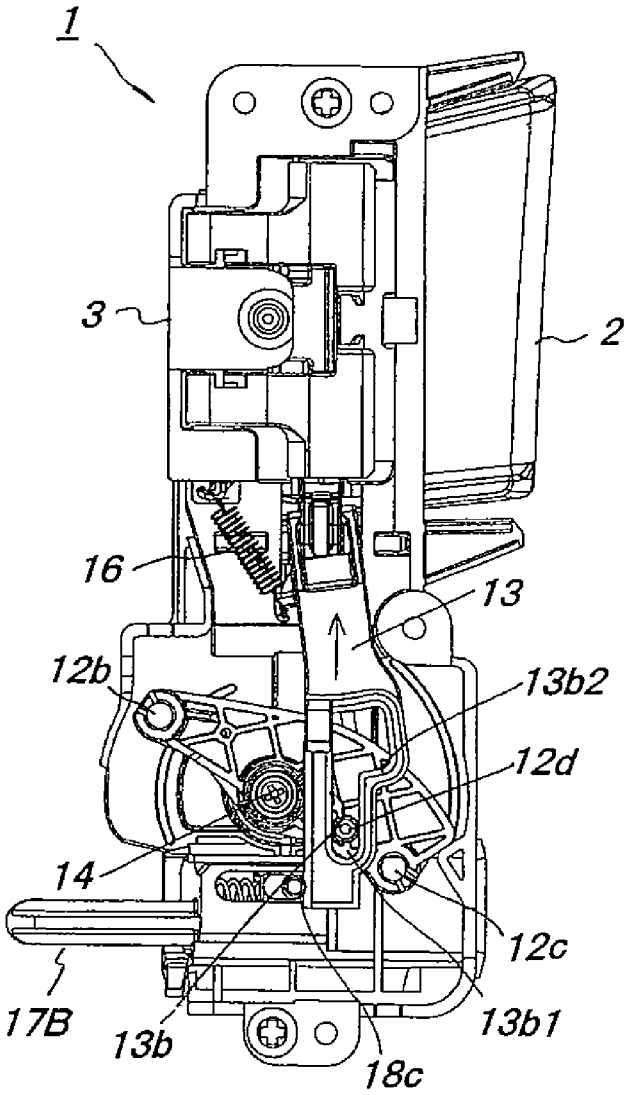
FIG. 11 is a rear view of the door lock system of the present invention, which shows a state in which the inner handle is manipulated while the door lock system is in the locked state.
Figure 12:
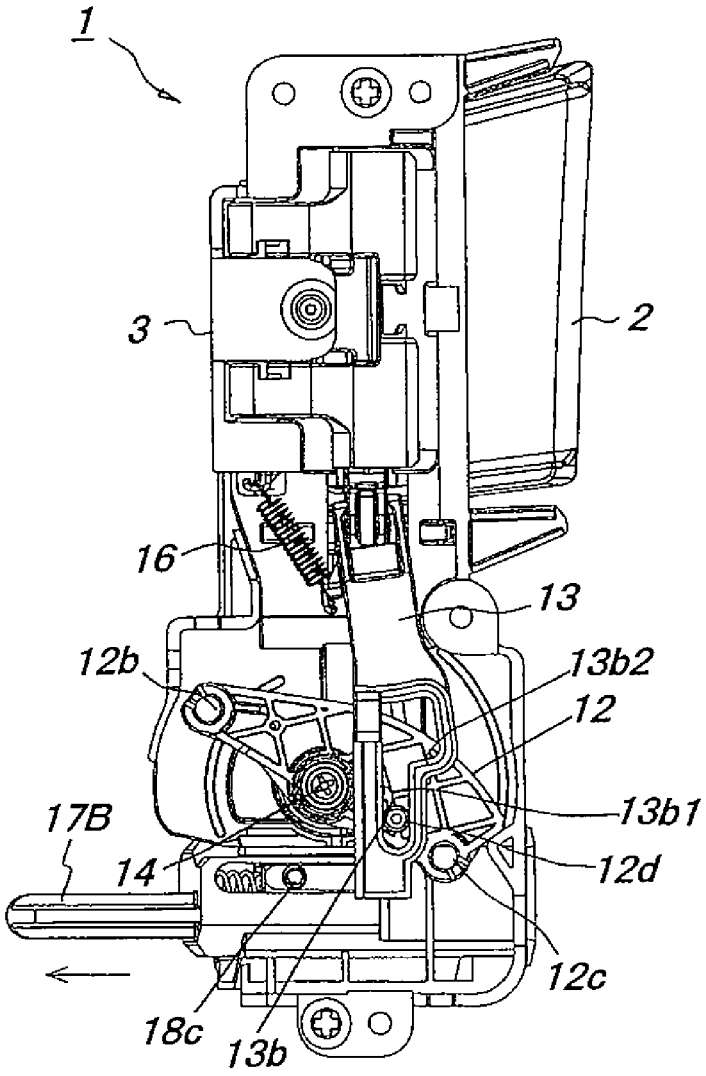
FIG. 12 is a rear view of the door lock system of the present invention, which shows a state in which a front door is set open while the door lock system is in the locked state.
Figure 13:
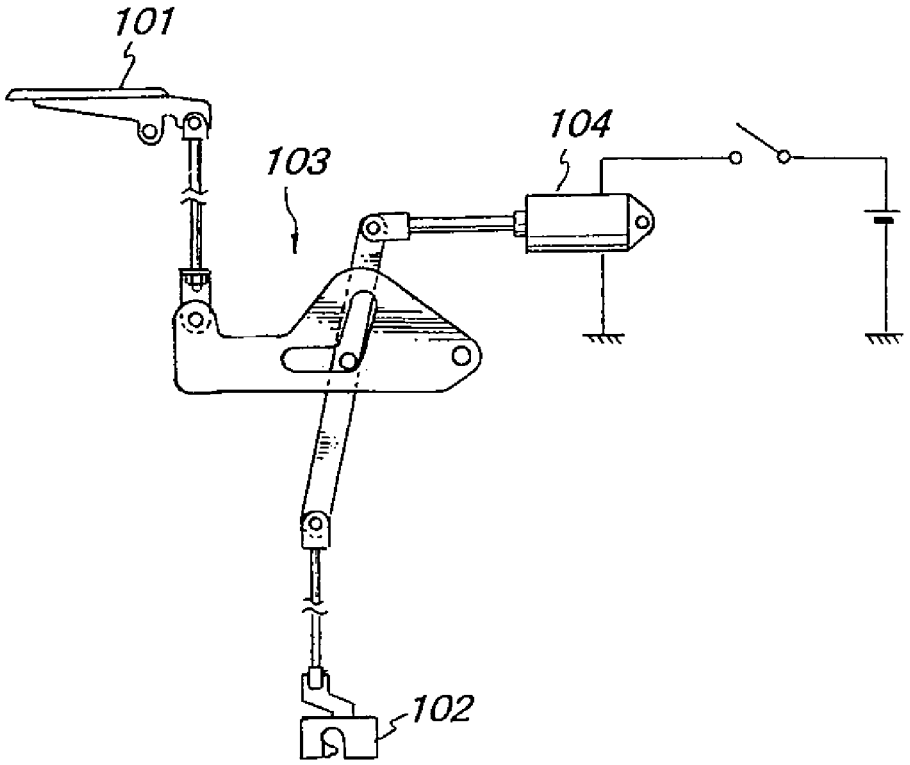
FIG. 13 is a diagram showing a basic structure of an opening/closing mechanism which has been proposed by Patent Document 1.
Figure 14:
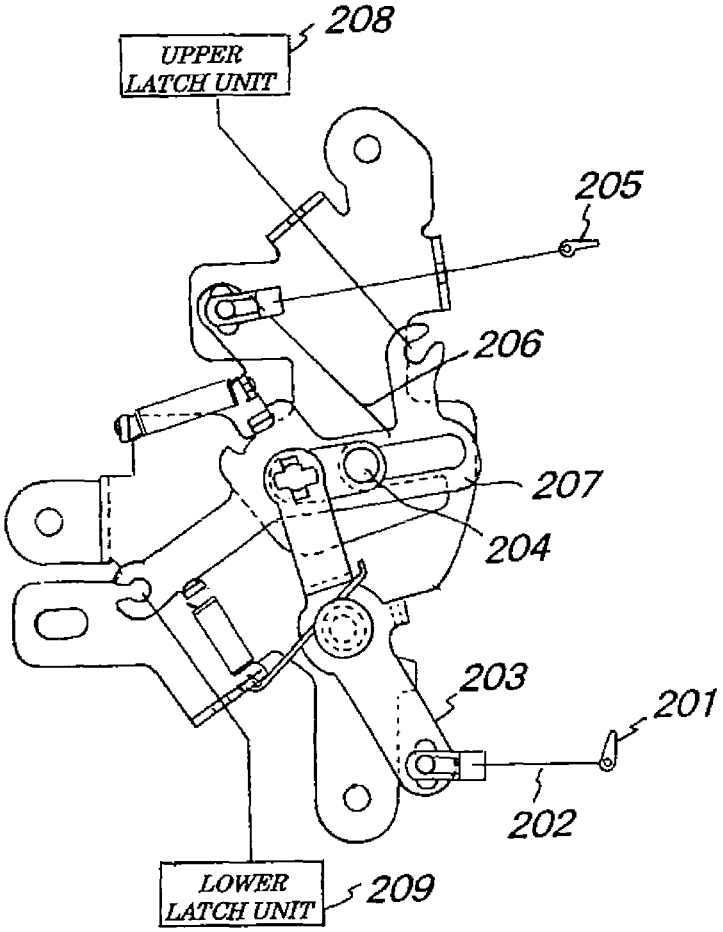
FIG. 14 is a diagram showing a basic structure of a door latch system which has been proposed by Patent Document 2.

FIG. 8 is a rear view of the door lock system, which shows an unlocked state of the door lock system. FIG. 9 is a rear view of the door lock system, which shows a state in which the inner handle is manipulated while the door lock system is in the unlocked state. FIG. 10 is a rear view of the door lock system of the present invention, which shows a locked state of the door lock system. FIG. 11 is a rear view of the door lock system, which shows a state in which the inner handle is manipulated while the door lock system is in the locked state. FIG. 12 is a rear view of the door lock system, which shows a state in which the front door is set open while the door lock system is in the locked state.

While the front door 52 and the rear door 53 shown in FIG. 1 and FIG. 2 are respectively in an opened state (unlocked state) and in a closed state (locked state), the contact portion 17B of the first slider 17 projects outward from the door lock system 1, as shown in FIG. 7A and FIG. 8 (as indicated with a dot-dash line in FIG. 2), because the contact portion 17B is away from the front door 52. During this time, the operation portion 18*c* of the second slider 18 is away from the handle-side transmission lever 13 because the operation member 5 is situated in a left limit position in FIG. 8. Accordingly, the handle-side transmission lever 13 is moved in the connected position by the biasing force of the spring 16, while the latch-side transmission lever 12 and the handle-side transmission lever 13 are in the connected state with the engagement portion 12*d* of the latch-side transmission lever 12 engaging with the step portion 13*b*2 of the guide groove hole 13*b* of the handle-side transmission lever 13.

Once the occupant turns the inner handle 2 around the support shaft 6 by pulling the inner handle 2 in the depth direction in the sheet of FIG. 9 from the state shown in FIG. 8, the turning movement of the inner handle 2 is converted into the turning movement of the rotary lever 10, and the handle-side transmission lever 13 connected to the rotary lever 10 accordingly moves upwards. Once the handle-side transmission lever 13 moves upwards, the step portion 13*b*2 of the guide groove hole 13*b* of the handle-side transmission lever 13 comes into engagement with the engagement portion 12*d* of the latch-side transmission lever 12, and the latch-side transmission lever 12 accordingly turns around the screw 14 in the counterclockwise direction in FIG. 9 against the biasing force of the coil spring 15 (see FIG. 5). Thereby, both of the control cables 60, 61 connected respectively to the first connection portion 12*b* and the second connection portion 12*c* of the latch-side transmission lever 12 are pulled; the upper and lower latch units 58, 59 (see FIG. 1) are thus operated; the rear door 53 is hence unlocked; and the rear door 53 is accordingly allowed to be opened. Thereafter, once the manipulation of the inner handle 2 is released, the inner handle 2 turns toward the initial position due to the biasing force of the spring 9; the rotary lever 10 rotates in response to the turn of the inner handle 2; the handle-side transmission lever 13 moves downwards; and the handle-side transmission lever 13 accordingly returns to the state which exists before the occupant manipulates the inner handle 2 (to the state shown in FIG. 8).

Subsequently, once the rear door 53 is closed and put into the closed state while the opened front door 52 is closed and put into the closed state, the inner panel 52*b* of the front door 52 comes into contact with and presses the contact portion 17B of the first slider 17, as indicated with a solid line in FIG. 2. At this time, in the operation member 5, as shown in FIG. 7B, the first slider 17 is pressed rightwards in the drawing, as well as the first slider 17 and the second slider 18 integrally move rightwards in the drawing with the first spring 19 alone compressed and with the second spring 20 not compressed, because as described above, the biasing force of the first spring 19 is set smaller than the biasing force of the second spring 20.

Thereafter, once as shown in FIG. 7B, the right end of the second slider 18 comes into contact with the restriction portion 3*i* which is formed in the operation member housing portion 3B of the base member 3, the operation portion 18*c* of the second slider 18 comes into contact with the handle-side transmission lever 13, as shown in FIG. 10. Thus, the operation portion 18*c* moves the handle-side transmission lever to the unlocked position (the position in which the engagement portion 12*d* of the latch-side transmission lever 12 engages with the long hole portion 13*b*1 of the guide groove hole 13*b* of the handle-side transmission lever 13) against the biasing force of the spring 16.

The first slider 17 is configured to subsequently move a predetermined distance while compressing the second spring 20. For this reason, even if the distance between the front door 52 and the first slider 17 varies depending on the precision of the parts, this variation is absorbed by the movement of the first slider 17. To put it specifically, even if the dimensional precisions of the front door 52 and the first slider 17 vary in ranges a, b shown in FIG. 7B in the right-left direction, the second slider 18 surely moves to a predetermined position, and the parts are prevented from being damaged by an excessive movement of the second slider 18.

Once the occupant turns the inner handle 2 around the support shaft 6 by pulling the inner handle 2 in the depth direction in the sheet of FIG. 11 after as shown in FIG. 10, the latch-side transmission lever 12 and the handle-side transmission lever 13 of the door lock system 1 are put into the unlocked state due to the closing of the front door 52, the turning movement of the inner handle 2 is converted into the turning movement of the rotary lever 10, and the handle-side transmission lever 13 connected to the lower end of the rotary lever 10 accordingly moves upwards.

Meanwhile, the engagement portion 12*d* of the latch-side transmission lever 12 only moves inside the long hole portion 13*b*1 of the guide groove hole 13*b* of the handle-side transmission lever 13, and the operation force of the handle-side transmission lever 13 is not transmitted to the latch-side transmission lever 12. For this reason, the latch-side transmission lever 12 does not turn, nor do the latch units 58, 59 operate. Accordingly, the rear door 53 is kept in the locked state, and the rear door 53 cannot be opened.

Even if the occupant manipulates the inner handle 2, the occupant cannot open the rear door until the front door 52 is set open. Once, however, the front door 52 is set open while the inner handle 2 is manipulated, the pressing of the operation member 5 by the front door 52 is released, and the operation member 5 accordingly projects outwards (in a direction indicated with an arrow shown in the drawing), as shown in FIG. 12. At this time, because the engagement portion 12*d* of the latch-side transmission lever 12 is situated inside the long hole portion 13*b*1 of the guide groove portion 13*b* of the handle-side transmission lever 13, the handle-side transmission lever 13 is kept in the unlocked position with the movement of the handle-side transmission lever 13 towards the connected position being restricted. Because, however, the operation member 5 and the handle-side transmission lever 13 are configured to be separable from each other, the operation member 5 alone moves leftwards in FIG. 12 due to the biasing force of the first spring 19.

Thereafter, once the manipulation of the inner handle 2 is released, the inner handle 2 turns to the initial position due to the biasing force of the spring 9; the rotary lever 10 thus turns in response to the turn of the inner handle 2; the handle-side transmission lever 13 hence moves downwards; and the engagement portion 12*d* of the latch-side transmission lever 12 and the long hole portion 13*b*1 of the guide groove hole 13*b* of the handle-side transmission lever 13 are disengaged from each other. Once the disengagement is achieved, the handle-side transmission lever 13 moves to the connected position due to the biasing force of the spring 16, and as shown in FIG. 8, the engagement portion 12*d* of the latch-side transmission lever 12 comes into engagement with the step portion 13*b*2 of the guide groove hole 13*b*. Accordingly, the handle-side transmission lever 13 and the latch-side transmission lever 12 are put into the connected state. Subsequently, once the occupant manipulates the inner handle 2 while in this state, the handle-side transmission lever 13 moves upwards as shown in FIG. 9, and thus makes the latch-side transmission lever 12 turn around the screw 14 in the counterclockwise direction in FIG. 9. Accordingly, both of the control cables 60, 61 respectively connected to the first connection portion 12*b* and the second connection portion 12*c* of the latch-side transmission lever 12 are pulled; the upper and lower latch units 58, 59 (see FIG. 1) are thus operated; the rear door 53 is hence unlocked; and the rear door 53 is allowed to be opened.

As described above, the door lock system 1 of the present invention is placed in the front end portion of the rear door 53, and the operation member 5 configured to come into contact with the front door 52 is placed in the base member 3. For these reason, connecting means, such as rods, for transmitting the operation of the operation member 5 to the door lock system 1 is no longer necessary; the door lock system 1, inclusive of the operation member 5, can be compactly placed in the front end portion of the rear door 53; and the degree of freedom can be enhanced in the shape of the rear door 53 and the layout of parts inside the rear door 53.

In addition, because the operation member 5 is formed as the slide member, the structure can be simplified. Furthermore, because the pin-shaped contact portion 17B of the first slider 17 constituting the part of the operation member 5 is configured to project outwards through the penetration hole 53*a*1 (see FIG. 2) formed in the outer panel 53*a* of the rear door 53, the part of the operation member 5 which is configured to project from the rear door 53 can be made in a smaller size, and the aesthetic impression can be enhanced.

Moreover, the door lock system 1 of the present invention makes unnecessary a slide pin for switching the handle-side transmission lever 13 between the connected position and the unconnected position, and accordingly makes it possible to reduce the number of parts and to simplify the structure.

Additionally, in the door lock system 1 of the present invention, the second spring 20 is interposed between the first slider 17 and the second slider 18, as well as the base member 3 is provided with the restriction portion 3*i* configured to restrict the movement of the second slider 18 beyond the predetermined limit. For this reasons, it is possible to prevent the second slider 18 configured to operate the handle-side transmission lever 13 of the disablement mechanism 4 from moving by an amount more than necessary; to make the second spring 20 absorb the variation in the distance between the rear end portion of the front door 52 closed to the vehicle body and the operation member 5 of the door lock system 1 which is placed in the rear door 53; and thereby to always make the disablement mechanism 4 work securely.

In addition, in the door lock system 1 of the present invention, the inner handle 2 is additionally placed in the base member 3 in which the disablement mechanism 4 and the operation member 5 are placed. For this reason, it is possible to obtain effects that: the parts integration can be achieved; and the door lock system 1 can be placed inside the rear door 53 more compactly. Moreover, although the inner handle 2 is placed in the base member 3, the door lock system 1 can be simply constructed because the turning force of the inner handle 2 can be directly transmitted to the handle-side transmission lever 13 of the disablement mechanism 4 by means of the single rotary lever 10.

Further, in the door lock system 1 of the present invention, the handle-side transmission lever 13 is constructed to interpose the latch-side transmission lever 12 between the front-side portion 13*c* and the rear-side portion 13*d*. For this reason, the position of the handle-side transmission lever 13 is restricted when the front-side portion 13*c* and the rear-side portion 13*d* of the handle-side transmission lever 13 come into contact with the latch-side transmission lever 12. Accordingly, the connection between the handle-side transmission lever 13 and the latch-side transmission lever 12 is securely maintained; other members for stopping the other side portion of the handle-side transmission lever 13 from rising becomes no longer necessary; the number of parts is reduced; and the door lock system 1 is constructed simply.

What is claimed is:

1. A door lock system for a vehicle having a rear door and a front door in which an ingress/egress opening is opened and closed by the front door and the rear door which are double opening doors, the door lock system switching the rear door and the front door to lock or unlock, the door lock system comprising:

a disablement mechanism configured to switch an inner handle and latch units between a connected state in which the disablement mechanism connects the inner handle and the latch units and a disconnected state in which the disablement mechanism disconnects the inner handle and latch units, the inner handle being connected to the disablement mechanism and being provided in the rear door, and the latch units being capable of keeping the rear door closed to the vehicle body;

a base member in which the disablement mechanism is placed; and an operation member connected to the disablement mechanism and configured to come into contact with the front door, to work in response to the opening and closing of the front door, and thereby to switch the disablement mechanism between the connected state in which the disablement mechanism connects the inner handle and latch units and the disconnected state in which the disablement mechanism disconnects the inner handle and latch units, wherein the door lock system is provided in a front end portion of the rear door, and the operation member configured to come into contact with the front door is movably provided in the base member, and, when the front door is closed, the disablement mechanism disconnects the inner handle and the latch units in response to contact of the operation member with the closed front door.

2. The door lock system of claim 1, wherein the operation member is slidably provided to the base member, the operation member is provided with a pin-shaped contact portion which is to come into contact with the front door, and the contact portion projects out toward the front door through a penetration hole formed in the rear door.

3. The door lock system of any one of claims 1 and 2, wherein the disablement mechanism includes:

a turnable latch-side transmission lever having a first connection portion in one end portion, a second connection portion in an other end portion of the turnable latch-side transmission lever, and an engagement portion configured to receive manipulation force generated by the inner handle, the first connection portion connected to a connection member connected to one of the latch units, the second connection portion connected to a connection member connected to the other latch unit; and a handle-side transmission lever configured to advance and retreat in response to manipulation of the inner handle, and being swingable between a connected position in which the handle-side transmission lever engages with an engagement portion of the latch-side transmission lever and an unconnected position in which the engagement is released, the operation member is provided to be capable of advancing and retreating in a swing direction of the handle-side transmission lever, and the operation member switches the handle-side transmission lever between a connected position and an unconnected position by engaging with or disengaging from the handle-side transmission lever.

4. The door lock system of claim 3, wherein the inner handle is pivotally supported at one end portion of the base member in a top-bottom direction by means of a support shaft extending in the top-bottom direction, the handle-side transmission lever of the disablement mechanism is placed in the other end portion of the base member in a way capable of advancing and retreating in the top-bottom direction, and a rotary lever shaped almost like a letter L is placed between the inner handle and the handle-side transmission lever, the rotary lever being pivotally supported by a support shaft which extends in a horizontal direction, one end of the rotary lever engaging with the inner handle, the other end of the rotary lever being joint-connected to the handle-side transmission lever, and the rotary lever converting turning force of the inner handle into advancing and retreating force of the handle-side transmission lever.

5. The door lock system of claim 3, wherein a supporting portion is provided to one end of the handle-side transmission lever, the supporting member being swingably supported by the rotary lever configured to transmit operation of the inner handle to the handle-side transmission lever, and a front-side portion and a rear-side portion are provided to the other end of the handle-side transmission lever, the front-side portion being situated in a front of the latch-side transmission lever, and the rear-side portion being situated in a rear of the latch-side transmission lever.

6. The door lock system of claim 3, wherein a guide groove hole including a step portion and a long hole portion is formed in the handle-side transmission lever, the step portion configured to engage with the engagement portion of the latch-side transmission lever, the long hole portion configured to guide the engagement portion of the latch-side transmission lever without engaging with the engagement portion, biasing means for biasing the handle-side transmission lever from an unconnected position to a connected position is provided, the unconnected position being a position, in advancing and retreating direction of the handle-side transmission lever, where the engagement portion and the long hole portion are opposed to each other, the connected position being a position, in the advancing and retreating direction of the handle-side transmission lever, where the engagement portion and the step portion are opposed to each other, and the operation member includes a slider configured to hold the handle-side transmission lever in the unconnected position by pressing the handle-side transmission lever while the front door is closed, and to allow the handle-side transmission lever to move to the connected position by moving in a direction away from the handle-side transmission lever while the front door is opened.

7. The door lock system of claim 1, wherein the operation member includes:

a first slider configured to come into contact with the front door;

a second slider configured to operate the handle-side transmission lever provided to the disablement mechanism;

a first spring configured to bias the first slider and the second slider toward the front door; and a second spring provided between the first slider and the second slider, and the base member includes a restriction member configured to engage with the second slider to thereby restrict movement of the second slider toward the disablement mechanism beyond a predetermined amount.

8. The door lock system of claim 1, wherein the inner handle is pivotally supported by the base member.

* * * * *